US008939782B2

(12) United States Patent
Trinh

(10) Patent No.: US 8,939,782 B2
(45) Date of Patent: Jan. 27, 2015

(54) PIVOTABLE DEVICE FOR A DETACHABLY FASTENING A CONDUCTOR ON A TRANSFORMER HOUSING

(75) Inventor: Dat-Minh Trinh, Barntrup (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 87 days.

(21) Appl. No.: 13/514,425

(22) PCT Filed: Dec. 17, 2010

(86) PCT No.: PCT/EP2010/070161

§ 371 (c)(1),
(2), (4) Date: Aug. 14, 2012

(87) PCT Pub. No.: WO2011/073432

PCT Pub. Date: Jun. 23, 2011

(65) Prior Publication Data

US 2012/0322284 A1 Dec. 20, 2012

(30) Foreign Application Priority Data

Dec. 17, 2009 (DE) ..... 10 2009 059 008

(51) Int. Cl.
*H01R 13/62* (2006.01)
*H01F 27/06* (2006.01)
*H01F 38/30* (2006.01)

(52) U.S. Cl.
CPC ..... *H01F 27/06* (2013.01); *H01F 38/30* (2013.01)
USPC ..... 439/261

(58) Field of Classification Search
USPC ..... 439/261, 253, 104, 11, 13
See application file for complete search history.

(56) References Cited

U.S. PATENT DOCUMENTS

| | | | | |
|---|---|---|---|---|
| 3,219,962 | A * | 11/1965 | Whalen | 439/104 |
| 4,258,348 | A | 3/1981 | Belfer et al. | |
| 4,408,175 | A | 10/1983 | Nelson et al. | |
| 5,426,360 | A | 6/1995 | Maraio et al. | |
| 5,483,215 | A | 1/1996 | Mies | |
| 5,810,628 | A | 9/1998 | Trudel et al. | |
| 6,146,217 | A * | 11/2000 | Osada | 439/835 |

(Continued)

FOREIGN PATENT DOCUMENTS

| | | |
|---|---|---|
| CH | 391034 | 4/1965 |
| DE | 700560 | 12/1940 |

(Continued)

OTHER PUBLICATIONS

English translation of Japanese Office Action dated Nov. 19, 2013 corresponding to Japanese Patent App. No. JP2012-543804, 6 pp.

(Continued)

*Primary Examiner* — Chandrika Prasad
(74) *Attorney, Agent, or Firm* — Ohlandt, Greeley, Ruggiero & Perle, LLP

(57) ABSTRACT

The invention relates to a device for detachably fastening a current conductor (10) to a current transformer housing (12), comprising a fastening element (18), which is fastened to a retaining element (16) arranged on the current transformer housing (12) and, when the current conductor (10) is fastened to the current transformer housing (12), rests at least partially on the surface of the current conductor (10). The invention is characterized in that the fastening element (18) is mounted pivotally on the retaining element (16).

7 Claims, 1 Drawing Sheet

(56) References Cited

U.S. PATENT DOCUMENTS

| | | | | |
|---|---|---|---|---|
| 7,275,954 | B2 * | 10/2007 | Ikenaga et al. | 439/494 |
| 7,306,478 | B2 * | 12/2007 | Kudo et al. | 439/494 |
| 8,403,684 | B2 * | 3/2013 | Tateishi et al. | 439/83 |
| 2008/0129314 | A1 | 6/2008 | Ricci et al. | |
| 2011/0235348 | A1 * | 9/2011 | Tateishi et al. | 362/459 |
| 2012/0315778 | A1 * | 12/2012 | Leifer et al. | 439/253 |

FOREIGN PATENT DOCUMENTS

| | | | |
|---|---|---|---|
| DE | 197 33 852 | A 1 | 2/1999 |
| DE | 10 2006 043 176 | A | 3/2008 |
| JP | 5133950 | Y1 | 8/1976 |
| JP | 61112626 | U | 5/1986 |
| JP | 08055745 | | 2/1996 |
| JP | 11347294 | | 12/1999 |
| JP | 2007321242 | A | 12/2013 |

OTHER PUBLICATIONS

German Office Action dated Jul. 15, 2014 corresponding to German Patent Application No. 10 2009 059 008.0, 5 pp.

* cited by examiner

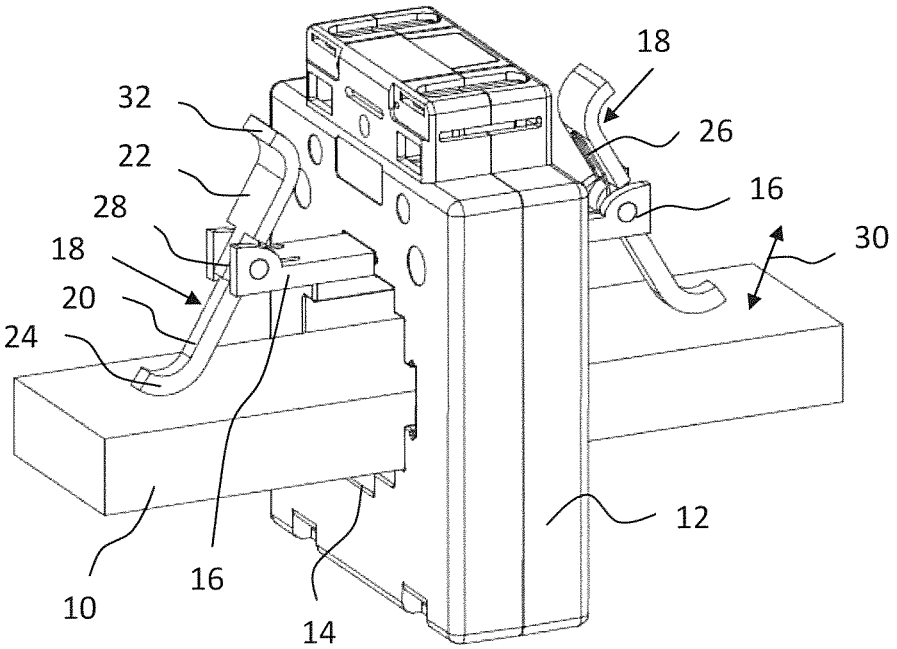
18
32
26
22
16
28
30
18
20
24
12
10
16
14

PIVOTABLE DEVICE FOR A DETACHABLY FASTENING A CONDUCTOR ON A TRANSFORMER HOUSING

CROSS-REFERENCE TO RELATED APPLICATIONS

This application is a United States national stage entry of International Application serial no. PCT/EP2010/070161 filed Dec. 17, 2010, which claims priority to German patent application no. 10 2009 059 008.0 filed Dec. 17, 2009. The contents of both of these prior applications are incorporated herein by reference in their entirety as if set forth verbatim.

FIELD

The innovation applies to a device for the detachable attachment of a conductor on a transformer housing with a fastening element, whereby the fastening element must be routed, so that the fastening element is placed onto the surface of the conductor at least partially when the conductor is attached to the transformer.

BACKGROUND

A conductor is usually routed through an opening that is provided on the transformer housing. The conductor is attached on the transformer housing with two screws or threaded pins, which are routed in two holding elements arranged on the transformer housing. For the purpose of fastening, the screws and/or threaded pins are turned inside of the holding element with a purely rotating movement in the direction of the conductor until their cross section is placed onto the surface of the conductor. Continued turning of the screws and/or threaded pins will result in securing the conductor in the transformer housing.

The disadvantage is hereby that the threaded pins and/or screws must travel a relatively long path for fastening on the conductor, whereby this occurs exclusively with a purely rotating movement, which requires a lot of force and time, especially with a larger number of transformer housings to be secured on a conductor.

Therefore, the innovation is based on the task to provide a device to fasten a conductor on a transformer housing, which is marked by a more simplified and faster installation.

SUMMARY

The solution for this task occurs according to the innovation with the characteristics of claim 1. Advantageous designs of the innovation are indicated in the subclaims.

The innovation-based device to fasten a conductor on a transformer housing has a fastening element, whereby the fastening element must be waged so that the fastening element is at least partially placed onto the surface of the conductor when the conductor is fastened on the transformer housing. The fastening element is characterized in that the fastening element is positioned on the holding element with panning capability.

Because the fastening element is positioned on the holding element with panning capability, a rotational movement around a rotation axis at a fastening point of the fastening element on the holding element. The fastening element can thereby be panned from an unsecured state, where the conductor is not secured on the transformer housing with the fastening element, to a secured state, where the conductor is secured on the transformer housing. The holding element is preferably designed in form of a metal guide or a flange, which protrudes from the outside of the transformer housing, whereby one holding element with a fastening element is preferably at each of the two longitudinal sides of the transformer housing. The conductor is preferably secured by panning the fastening element so that at least part of the fastening element is placed onto the surface of the conductor and whereby the conductor is secured on the transformer housing with the fastening element. The device according to the innovation makes an especially quick and easy fastening of a conductor on a transformer housing possible.

According to an advantageous design of the innovation, the fastening element has a retaining clip, which is placed onto the surface of the conductor when it is secured. The retaining clip must preferably be designed in form of a longitudinal bridge, whereby the longitudinal bridge has a curved area at the open end, whereby the part of the fastening element, which is placed onto the surface of the conductor when secured is provided in the area of the curved area. This makes it possible to produce especially great holding force on the conductor with the fastening element. The retaining clip can thereby be attached on the surface of the conductor, at least in certain partial areas of the retaining clip.

It is furthermore preferred to provide the fastening element so that it is positioned pre-tensioned on the retaining element with a spring. The spring must thereby preferably be provided in the area of the fastening element, where the fastening element is positioned with panning capability on the retaining element. The spring effects a pre-tension in that the fastening element can be kept with a certain tension in the secured state on the surface of the conductor. The effect of the spring is that the fastening element cannot be released without application of a certain amount of pressure from the surface of the conductor. This makes a secure fastening of the conductor with the fastening element according to the innovation possible.

Another advantageous design of the innovation is that the fastening element is positioned in the center along its longitudinal axis on the retaining element. The center position of the fastening element allows for an application of even force, especially holding force with the fastening element onto the conductor so that it is possible to securely attach the conductor. In addition, a centered position of the fastening element ensures an even panning movement of the fastening element. However, it is also possible that the fastening element is positioned at a position other than a center point along its longitudinal axis on the retaining element.

The fastening element is preferably operated with a lever on the fastening element. The user can use the lever to easily move the fastening element from an unsecured state to a secured state and vice-versa. The operation and/or handling of the device according to the innovation is thereby especially user-friendly.

The lever and retaining clip are designed with another advantageous design of the innovation along a common axis of the fastening element. The lever thereby represents sort of an extension of the retaining clip, whereby the retaining clip can be operated by the user with a lever, which is extremely easy. In addition, this makes it possible to design the fastening element symmetrical so that the fastening element can be provided as space-saving as possible.

The innovation will be explained in further detail below with reference to the attached drawings based on preferred designs.

BRIEF DESCRIPTION OF THE DRAWINGS

The only FIG. 1 shows a device according to the innovation according to a possible design.

DETAILED DESCRIPTION

FIG. 1 shows a device according to the innovation for the detachable fastening of a conductor 10 on a transformer housing 12, whereby the conductor 10 is fed through an opening 14 provided on a transformer housing 12. The transformer housing 12 has two retaining elements 16. One fastening 18 is positioned on each one with panning capability. FIG. 1 shows the device according to the innovation in a secured state where the fastening element 18 is at least partially placed onto the surface of the conductor 10. The fastening element 18 has a retaining clip 20 and a lever 22 on the retaining clip 20. The retaining clip 20 is placed on the surface of the conductor 10 in the secured state. The retaining clip 20 is designed in form of a bridge, whereby an open end 24 of the retaining clip 20 has a curved area, whereby the curve of the curved area points away from the conductor 10. The retaining clip 20 is hereby placed onto the surface of the conductor 10 in the area of its curved area. The lever 22 also has a curved area at its open end 32, whereby the lever 22 is easier to handle for a user.

The fastening element 18 is positioned pre-tensioned with a spring 26 on the retaining element 16. The fastening element 18 is positioned along its longitudinal axis on the retaining element 16, whereby the position is preferably at the connecting point 28 between the retaining clip 24 and lever 22. Panning the fastening element 18 in the direction of the arrow 30 transfers the fastening element 18 from a secured state to an unsecured state, whereby the device according to the innovation is shown in FIG. 1 in a secured state.

LIST OF REFERENCE SYMBOLS

Conductor 10
Transformer housing 12
Opening 14
Retaining element 16
Fastening element 18
Retaining clip 20
Lever 22
Open end 24
Spring 26
Connecting point 28
Arrow 30
Open end 32

What has been described above includes examples of one or more embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A device for the removable attachment of a conductor on a transformer housing, the device comprising a transformer housing having a first side and a second side and a through-hole connecting the first and second sides through which the conductor is fed, and a first fastening element attached to a first retaining element on the first side of the transformer housing, wherein the first fastening element is at least partially in contact with a surface of the conductor when the conductor is fed through the through-hole of the transformer housing, and wherein the first fastening element is pivotally mounted on the first retaining element.

2. The device of claim 1, wherein the fastening element further comprises a retaining clip that is in contact with the surface of the conductor when the conductor is in the secured state.

3. The device of claim 1, wherein the fastening element is positioned pre-tensioned on the retaining element with a spring.

4. The device of claim 1, wherein the fastening element is positioned on the retaining element along the center of its longitudinal axis.

5. The device of claim 1, wherein the fastening element further comprises a lever to pivotally operate the fastening element.

6. The device of claim 5, wherein the lever and retaining clip are arranged along a common axis of the fastening element.

7. The device of claim 1, further comprising a second fastening element attached to a second retaining element on the second side of the transformer housing, wherein the second fastening element is at least partially in contact with a surface of the conductor when the conductor is fed through the through-hole of the transformer housing, and wherein the second fastening element is pivotally mounted on the second retaining element.

* * * * *